United States Patent [19]

Armstrong et al.

[11] 4,193,600

[45] Mar. 18, 1980

[54] CRIBBAGE SCORING DEVICE

[75] Inventors: Roy Armstrong, Waltham, Mass. 02135; William M. Kahn, Brookline, Mass.

[73] Assignee: Roy Armstrong, Waltham, Mass.

[21] Appl. No.: 861,613

[22] Filed: Dec. 19, 1977

[51] Int. Cl.[2] ..... A63F 1/18

[52] U.S. Cl. ..... 273/148 R; 273/1 ES; 340/323 R

[58] Field of Search ..... 40/52 R; 235/92 CC, 235/92 GA; 273/1 E, 1 ES, 85 R, 85 G, 86 B, 148 R, 237, DIG. 26, DIG. 28; 340/323 R; 116/120; 364/411

[56] References Cited

U.S. PATENT DOCUMENTS

| | | | |
|---|---|---|---|
| 3,189,888 | 6/1965 | Bradley | 273/148 R |
| 3,310,308 | 3/1967 | Reagan | 273/85 R |
| 3,420,526 | 1/1969 | Berger | 273/148 R |
| 4,015,846 | 4/1977 | Runte et al. | 273/85 G |
| 4,030,764 | 6/1977 | Mattos | 273/148 R X |
| 4,059,272 | 10/1977 | Pullman | 273/237 X |
| 4,130,871 | 12/1978 | Olsen et al. | 235/42 GA |

*Primary Examiner*—Vance Y. Hum

*Attorney, Agent, or Firm*—Wolf, Greenfield & Sacks

[57] ABSTRACT

A cribbage scoring device having an input device, a display device, and electronic circuitry to exercise the display device and provide the card players with scoring information. The device is preferably embodied in a relatively small housing. Each card player has a keyboard section to input scoring information and several display sections to display one's own score as well as the difference between one's score and an opponent's score. The electronic circuitry is located within the housing, consists of six subsystems: keyboard, memory, display, clock, instruction decode and sequence decode, and modification logic. The device may be operated either by battery or from an AC line.

16 Claims, 8 Drawing Figures

RAM FORMAT

| $A_5$ | $A_4$ | $A_3$ | $A_2$ | $A_1$ | $A_0$ | N \ BIT | 4 | 3 | 2 | 1 | |
|---|---|---|---|---|---|---|---|---|---|---|---|
| 0 | 0 | 0 | 0 | 0 | 0 | 0 | LAST ENTRY | | | D1 | KEY BOARD NO. 1 |
| 0 | 0 | 0 | 0 | 0 | 1 | 1 | LAST ENTRY | | | D2 | |
| | | | | | | 2 | SCORE | | | D1 | |
| | | | | | | 3 | SCORE | | | D2 | |
| | | | | | | 4 | SCORE | | | D3 | |
| | | | | | | 5 | DIFF | | | D1 | |
| | | | | | | 6 | DIFF | | | D2 | |
| | | | | | | 7 | DIFF | | | SIGN | |
| 0 | 0 | 1 | 0 | 0 | 0 | 8 | | | | | 2 |
| | | | | | | ⋮ | | | | | |
| | | | | | | 15 | | | | | |
| 0 | 1 | 0 | 0 | 0 | 0 | 16 | | | | | 3 |
| | | | | | | ⋮ | | | | | |
| | | | | | | 23 | | | | | |
| 0 | 1 | 1 | 0 | 0 | 0 | 24 | | | | | 4 |
| | | | | | | ⋮ | | | | | |
| | | | | | | 31 | | | | | |
| 1 | 0 | 0 | 0 | 0 | 0 | 32 | NOT USED | | | SKUNK 1 | |
| | | | | | | 33 | | | | SKUNK 2 | |
| | | | | | | 34 | | | | SKUNK 1 | |
| | | | | | | 35 | | | | SKUNK 2 | |
| | | | | | | 36 | | | | SKUNK 1 | |
| | | | | | | 37 | | | | SKUNK 2 | |
| | | | | | | 38 | | | | SKUNK 1 | |
| 1 | 0 | 0 | 1 | 1 | 1 | 39 | | | | SKUNK 2 | |

KEYBOARD ENCODING

| KEY \ RAMBIT | 4 | 3 | 2 | 1 |
|---|---|---|---|---|
| 0 | 1 | 0 | 0 | 0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| C | 1 | 1 | 0 | 1 |
| + | 1 | 1 | 1 | 0 |
| − | 1 | 1 | 1 | 1 |

CRIBBAGE SCORING DEVICE

BACKGROUND OF THE INVENTION

The game of Cribbage is a popular card game involving both skill and chance. It is a game which provides each player numerous scoring opportunities, from the cards played by each player as well as those played by an opponent. Normally, to win a Cribbage game, one must score 121 points. These points are obtained in several ways for each fixed card hand played. For example, points are obtained by throwing out cards, by achieving "go" points, by having scoring cards in your hand, and by obtaining the dealer's kitty. Thus, during a single six-card hand, there are several scoring opportunities requiring an addition to the cumulative score for each player.

Traditionally, the scoring of Cribbage is accomplished by use of a peg board device, which typically has two tracks of peg holes, one representing one player's score and the other representing an opponent's score. As points are accumulated for each player, the peg is moved along the row of holes to a particular pegboard hole location, representing the number of points scored by the player. In addition, there is a "backpeg" which represents the quantity of points accumulated by a player prior to a last scoring entry.

There are several problems inherent in the conventional pegboard device scoring system. Use of the pegboard scoring device requires each player to calculate a new score as well as to accurately move the peg from one position to a new position. Additionally, it is inconvenient for one player to accurately determine the score of his opponent by use of such a device. This system of scoring lends itself to numerous mistakes on the part of each player. Also, the pegboard device does not provide an easily discernable method of calculating a score or, for that matter, of displaying a particular score.

This is therefore a need for a scoring device that will accurately calculate and display a cribbage player's score so that each player involved in the game has access to the scores of all other players. In addition, a device is needed which provides additional scoring information, particularly suited to the game of cribbage.

BRIEF DESCRIPTION OF THE INVENTION

The present invention is an electronic cribbage scoring device having a surface upon which are delineated playing positions for a plurality of card players, and input and display means for providing scoring information. The device described herein can be used in either two-player, three player or four-player cribbage games. However, it can be appreciated by those skilled in the art that the invention described herein can be adapted for a cribbage game containing more than four people.

The electronic cribbage scoring device is arranged to provide each player means to input a score and means to display various scoring information. There are essentially five elements provided at each player location. Each player has a keyboard section, a display device for indicating a score, a display device for indicating a scoring differential, a display device for indicating a "last entry" score, and two display devices for indicating various scoring conditions commonly referred to as "skunk" and "double skunk" conditions.

The keyboard section has input buttons numbered 0 through 9 as well as a + button, − button and a C or clear button. These button devices are similar to the buttons commonly found in pocket calculators and the like. The scoring device is a three-digit scoring device which allows each player to know his cumulative score at that particular time in the game. The differential scoring device provides a number with an appropriate plus or minus sign which indicates the differential in that particular player's score relative to the score of an opponent. When playing with four players, the differential score can be the difference between the player having the highest score and the other players. Several alternative ways of indicating a differential score are known to those skilled in the art. The last entry scoring display represents the last entry. The two skunk scoring displays indicate when a player is being skunked or double skunked. In the game of cribbage, a player is in a skunk condition when he is behind an opposing player by more than thirty points. Accordingly, a double skunk indicates that a player is behind an opponent by more than sixty points.

The arrangement of the device, with its necessary input and display means, is such that each player can easily determine his own score as well as input his score into the game. The overall size of the playing surface can be as large or as small as the players require. The entire device is easily portable so that the size of the device can conveniently fit within a conventional attache case or, if a more standard sized device is needed, it can be as large as a card table or the like.

The electronic circuitry associated with the present invention is located beneath the top surface of the device, and can be fabricated in various ways known to those skilled in the art. For example, the components necessary to input and display the necessary information can be mounted upon a printed circuit board or, if greater sophistication is desired, most of the circuitry can be mounted or incorporated in a small chip. The type of circuit construction chosen depends upon the size and weight requirements of the particular board.

The electronic circuitry necessary to input, process and display the necessary scoring information comprises basically six subsystems. These six subsystems are a keyboard, memory, display, clock, instruction decode and sequence control, and modification logic.

The keyboard is the device which provides the data input to the circuit, and thus determines the data to be processed by the remaining portions of the circuit. The memory subsystem stores both processed and unprocessed data, and eventually transfer the processed data to the display subsystem. The modification logic subsystem performs the necessary calculations upon the unprocessed data, whereupon the unprocessed data is transformed to processed data and returned to the memory. The instruction decoding and sequence control subsystem controls the performance of substantially the entire circuit by providing the circuit with its necessary command timing signals. The clock is a standard timing device which provides a means of synchronizing the various signal interactions. Each of these subsystems will be explained in greater detail below.

DETAILED DESCRIPTION OF THE INVENTION

Figure 1:
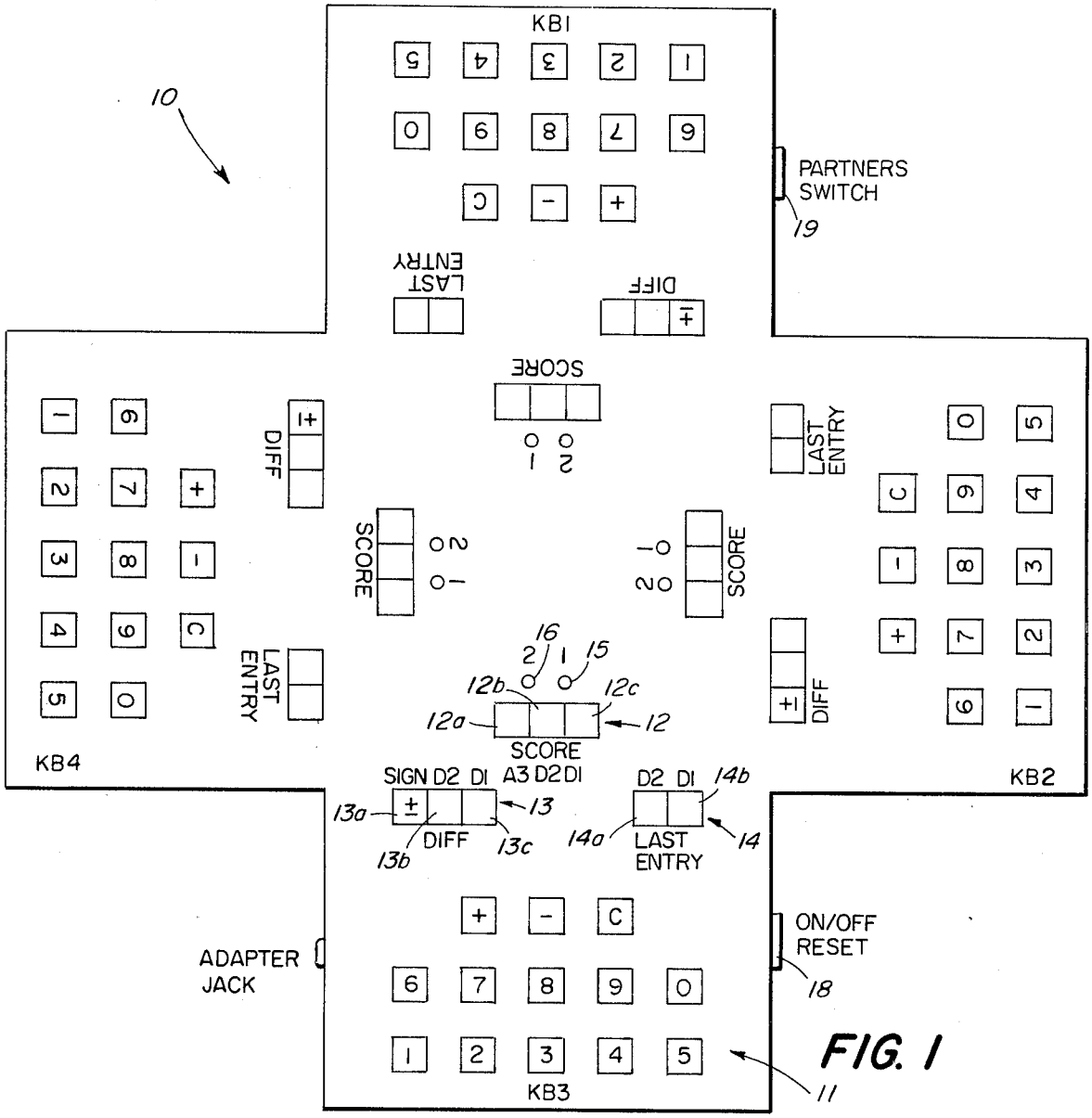
FIG. 1 is a top view of the cribbage scoring board device.

The present invention is an electronic Cribbage board device, shown generally as 10 in FIG. 1, which is capable of inputting and outputting scoring information for each player involved in a Cribbage card game. The Cribbage board scoring device 10, having four player positions, is a preferred embodiment of the present invention. It can be appreciated by those skilled in the art that the present invention can be adapted to be used by any number of Cribbage card players.

For each player position, the inputting and outputting components are essentially the same. Each player has a keyboard input device 11, comprising 13 input keys of buttons, known generally to those skilled in the art. The buttons input the numbers 0 through 9 as well as a + or add button, a − or subtract button, and a C or clear button. When a player seeks to input a score, he merely depresses the appropriate button or buttons. If he seeks to add that numerical amount to his score, he presses the + or add button, and if for some reason he seeks to subtract that numerical amount from his score (for example, to correct an error) he presses the − or subtract button. The C button will clear the keyboard of a keyboard entry without affecting the score and thus make it ready for another keyboard input.

The display devices 12, 13, 14, 15 and 16 are identical for each player position. Display device 12 comprises three numerical positions, 12*a*, 12*b*, and 12*c*, so that numbers in the hundreds may be displayed. This is necessary due to the fact that the winning number of points in the game of Cribbage is 121. Display device 12 shows each player his present cumulated score and thus provides a quick and easily discernible method of determining one's own score. The display device 13 is a three-position display device, wherein the left-hand display location 13*a* indicates a positive or negative sign. This sign represents whether a player is behind (−) or ahead of (+) an opposing player. The remaining two display locations, 13*b* and 13*c*, display to the player the difference between his score and his opponent's score. This display device is caused to operate continuously during partner play and upon game conclusion during 4-man individual play. Display device 14, having two display locations 14*a* and 14*b* displays the last entry made by the individual player to his score. Conventionally, this last entry was tracked by the back peg on a standard conventional Cribbage board. Display devices 15 and 16 indicate a single and double skunk condition, respectively. In the game of Cribbage, when, at the end of the game, the difference between a player's score and his opponent's exceeds 30 points, a single skunk condition is present, and when a player's score exceeds his opponent's score by 60 points, a double skunk condition is present. As can be seen, each player position is organized to have identical display devices 12, 13, 14, 15, and 16, as well as keyboard input device 11. The input and display devices may be supported commonly and the support surface may form a part of a housing also for containing the electronics.

Additionally, there exists an on/off reset switch shown generally as 18, and a partner switch, shown generally as 19. The partner switch 19, when activated, places the display device in a partner-play mode, whereupon the display device 13 functions continuously.

The on/off reset switch turns the device on or off, as well as resetting the necessary display devices between games.

Figures 2, 6, 7:
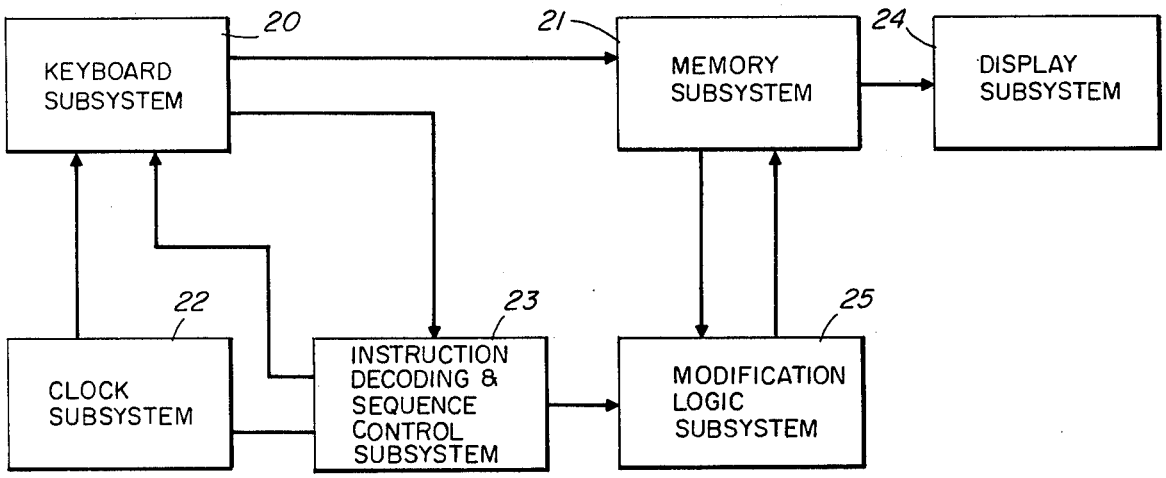
FIG. 2 is a block schematic diagram detailing the main functions of the present scoring device.
FIG. 6 is a chart depicting the random access memory organization.
FIG. 7 is a chart depicting the keyboard encoding scheme.

In FIG. 2 is shown, schematically, the six main electronic functions contained within the device. The keyboard subsystem 20, comprising a plurality of keyboard sections, is shown to interact with the memory subsystem 21, the clock 22 and the instruction decoding and sequence control subsystem 23. Each keyboard section represents the keyboard portion for each player position. In FIG. 1, the keyboard sections are labeled KB1, KB2, KB3, and KB4. The memory subsystem 21 is shown to supply and receive data from the modification logic subsystem as well as to supply data to the display subsystem 24. The instruction decoding and sequence control subsystem 23 reacts with the modification logic subsystem 25, keyboard subsystem 20 and clock 22. A more detailed description of the individual subsystems and their electrical relationships is given below.

Figure 3A:
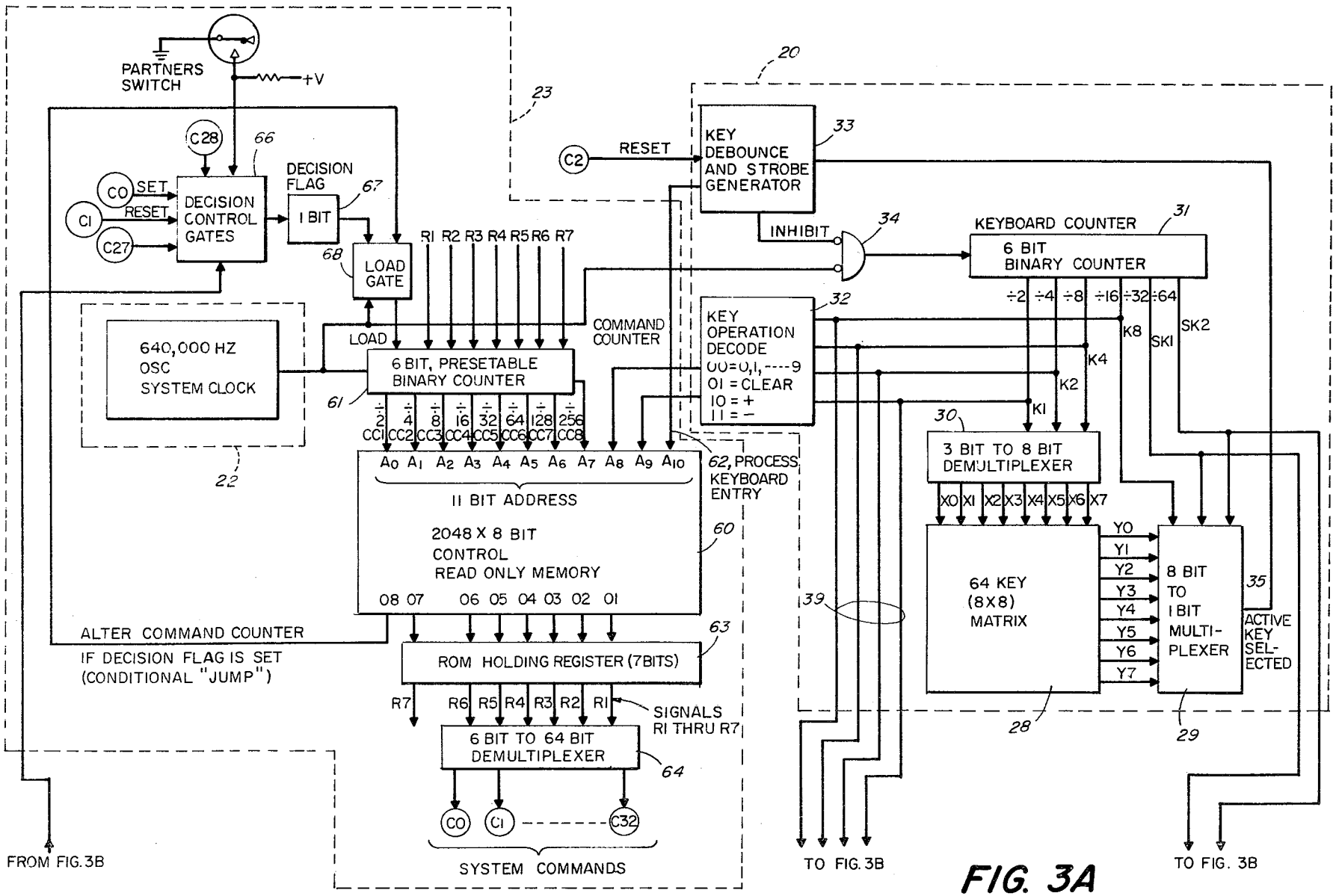
FIGS. 3A and 3B are schematic diagrams showing the contents of each of the blocks described in FIG. 2.
Figure 3B:
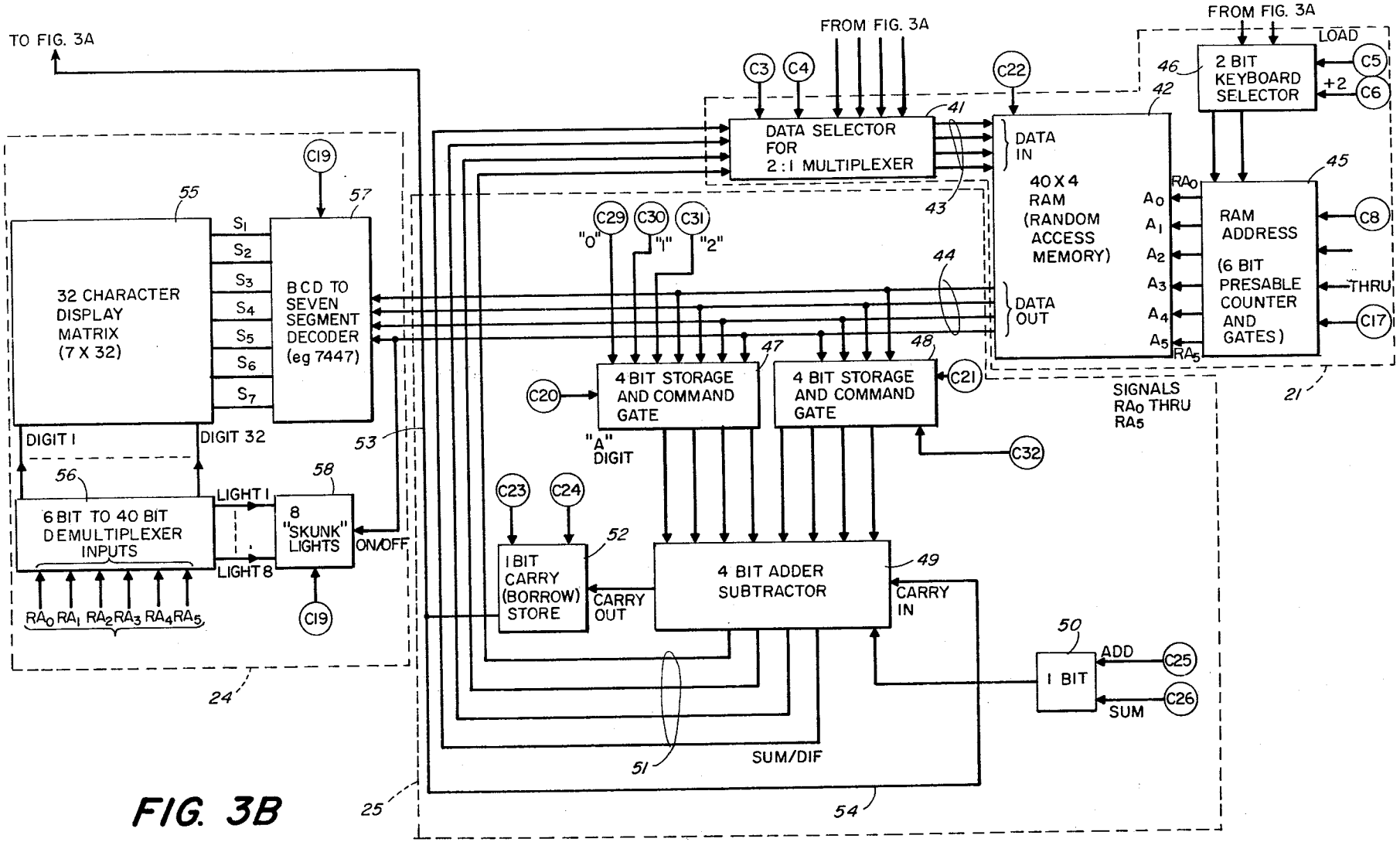

In FIGS. 3A and 3B is shown the electronic contents of each subsystem described in FIG. 2. In FIG. 3A they keyboard subsystem 20, clock subsystem 22, and instruction decoding and sequence control subsystem 23 are shown within the dotted line boxes.

The keyboard subsystem 20 comprises a 64-key matrix 28, an eight-bit to one-bit multiplexer 29, a three-bit to eight-bit demultiplexer 30, a six-bit binary counter 31, a key operation decode 32, a key debounce and strobe generator 33 and inhibit gate 34. Key matrix 28 is shown schematically in greater detail in FIG. 4 and explained below. The binary counter 31 is caused to be free-running from the clock subsystem 22. The free-run condition exists until a keyboard key is depressed, whereupon the output 25 of multiplexer 29 is energized which in turn stops the counter 31 from counting. The counter 31 determines which particular key in the keyboard array has been depressed. The binary code number from the counter 31 is inputted along data lines 39 into data selector 41 of memory subsystem 21. The key operation decoder 32 informs the instruction decoding and sequence control subsystem 23 the particular state of the keyboard subsystem 20. The instruction decode and sequence control (IDS) subsystem 23 is thus told whether a digit 0–9, C (clear) command, + command, or − command has been entered into the keyboard subsystem. The key operation decoder provides a binary 00 for a digit input, a binary 01 for a "clear" input, a binary 10 for a "+" input, and a binary 11 for a "−" input. The keyboard counter 31, key operation decode 32, multiplexer 29 and inhibit gate 34 are common integrated circuit devices known to those skilled in the art. It can be appreciated that the logic function of these discrete devices can be utilized in the implementation of a single chip large scale integrated circuit for purposes of cost, weight and size.

The memory subsystem 21 comprises a 4×40 random access memory (RAM) 42 whose purpose is to receive data along data input lines 43, to store said data, and to output said data when required along output data lines 44. In addition, a six-bit counter and gate device 45 is utilized to address random access memory 42. A two-bit keyboard selector 46 is utilized to determine which particular keyboard of the four player keyboards is being exercised at a particular time. RAM 42 is continuously reading out data information along data output lines 44. When command signal C22 is inputted into RAM 42, new information is gated or strobed into RAM 42 along data lines 43.

The data output from RAM 42 along data output lines 44 is inputted into the modification logic subsystem 25 or directly into the display subsystem 24. The basic function of the modification logic subsystem 25 is to modify or process the raw data information received from memory 42 according to the commands from IDS control subsystem 22. These commands are basically ones that order the modification logic subsystem 25 to add, subtract and carry appropriate digits in order to perform the necessary mathematical functions upon raw data. Once the data has been appropriately processed, it is returned to the memory subsystem 21 along lines 51. Within the modification logic subsystem 25 there is a plurality of four-bit storage and command gates 47 and 48, which input a four-bit adder-subtractor 49. Connected to adder-subtractor 49 is a one-bit add-/subtract control storage element 50 and a one-bit carry (borrow) storage element 52. Storage element 52 is connected to the IDS control subsystem 23 along line 53 and also inputted into the adder-subtractor 49 along line 54. The output of adder-subtractor 49 inputs the data selector 41 in memory subsystem 21. Thus, the modification logic subsystem 25 has modified and processed the data output from the random access memory 42 and returned the processed information to the data selector 41 which inputs the random access memory 42. This processed data information can then be displayed in data display subsystem 24. It can be appreciated that the components within the modification logic subsystem are off-shelve components or logic subsystems that are known to those skilled in the art.

The data display subsystems 24 comprises a 32 character display matrix 55, a six-bit to 40-bit demultiplexer 56, a seven segment decoder 57, and eight "skunk" lights 58. The seven segment decoder, typically IC No. 7447, is a four-bit to seven-bit decoder. Information is strobed into the seven segment decoder as well as the eight "skunk" lights 58 upon activation of command signal C19. When this command signal occurs, the random access memory is addressed pursuant to command signal C7. Thus, information is displayed upon command of C19 and the random access memory 42 is incremented by command signal C7. In the display matrix 55, a standard seven-segment LED display device is used. Hence, the four-segment to seven-segment decoder 57 provides the necessary segment excitation. The demultiplexer 56 provides the proper addressing and thus completes a display circuit for those characters desired to be activated. A more detailed description of the display subsystem is provided below.

The clock subsystem 22 in FIG. 3A is a standard oscillator known to those skilled in the art. In the preferred embodiment described herein, the clock oscillates at a frequency of 640,000 Hz.

The IDS control 23 is the central processor unit which controls the operation of the entire device by producing various system commands to the circuit. The IDS control 23 issues various system commands based upon the condition and status of the other subsystems in device 10. The main element within IDS control 23 is the read-only memory (ROM) 60, which is a 2048 by eight-bit memory. A six-bit presettable binary counter 61 is the instruction or command counter, by which the ROM is consistently addressed. Counter 61 is connected to Clock Subsystem 22 so that the counter is continuously counting and thus addressing the ROM 60. The ROM 60 is instructed that a keyboard entry has been made by the introduction of the process keyboard entry 62 to ROM 60, which originates from the key debounce and strobe generator 33 which is part of the keyboard subsystem 20. Thus, the ROM 60 is automatically addressed by controlling the address-bit from the process keyboard entry 62. Connected to ROM 60 is a seven-bit ROM holding register 62 which also connects to a five-bit to 64-bit demultiplexer 64. The output of demultiplexer 64 provides the 32 system commands identified as C0 through C32. These system commands are as follows:

SYSTEM COMMANDS

C0 Set Decision Flag
C1 Reset Decision Flag
C2 Reset Key Scan Inhibit
C3 Set Data Selector to Keyboard
C4 Set Data Selector to Sum/Dif
C5 Set Keyboard Selector from Keyboard Counter
C6 Increment Keyboard Selector
C7 Increment RAM address
C8–C17: Set Ram Address from Keyboard Selector as follows:
- C8 Last Entry D1
- C9 Last Entry D2
- C10 Score D1
- C11 Score D2
- C12 Score D3
- C13 Diff D1
- C14 Diff D2
- D15 Diff Sign
- C16 Skunk 1
- C17 Skunk 2

C18 Set RAM Address to Zero
C19 Strobe Display Matrix
C20 Load A Digit
C21 Load B Digit
C22 Store Data Selector Output In RAM
C23 Set Carry Bit
C24 Reset Carry Bit
C25 Set Control Bit to "ADD"
C26 Set Control Bit to "SUBTRACT"
C27 Load Decision Flag From Carry (Borrow) Store
C28 Set Decision Flag if Partner Switch is ON
C29 Set A Digit to "0"
C30 Set A Digit to "1"
C31 Set A Digit to "2"
C31 Set B Digit to "0"

These system commands are employed throughout the device to initiate, process, sequence and perform all functions necessary to carry out the desired data modification and display. The need for each system command and their command sequence can be appreciated by those skilled in the art.

Decision control gates 66, decision flag 67, and load gate 68 are also within the ID control subsystem 23. These components are utilized to establish a conditional jump and thus alter the command counter 61 if a decision flag from 67 is set.

Figure 4:
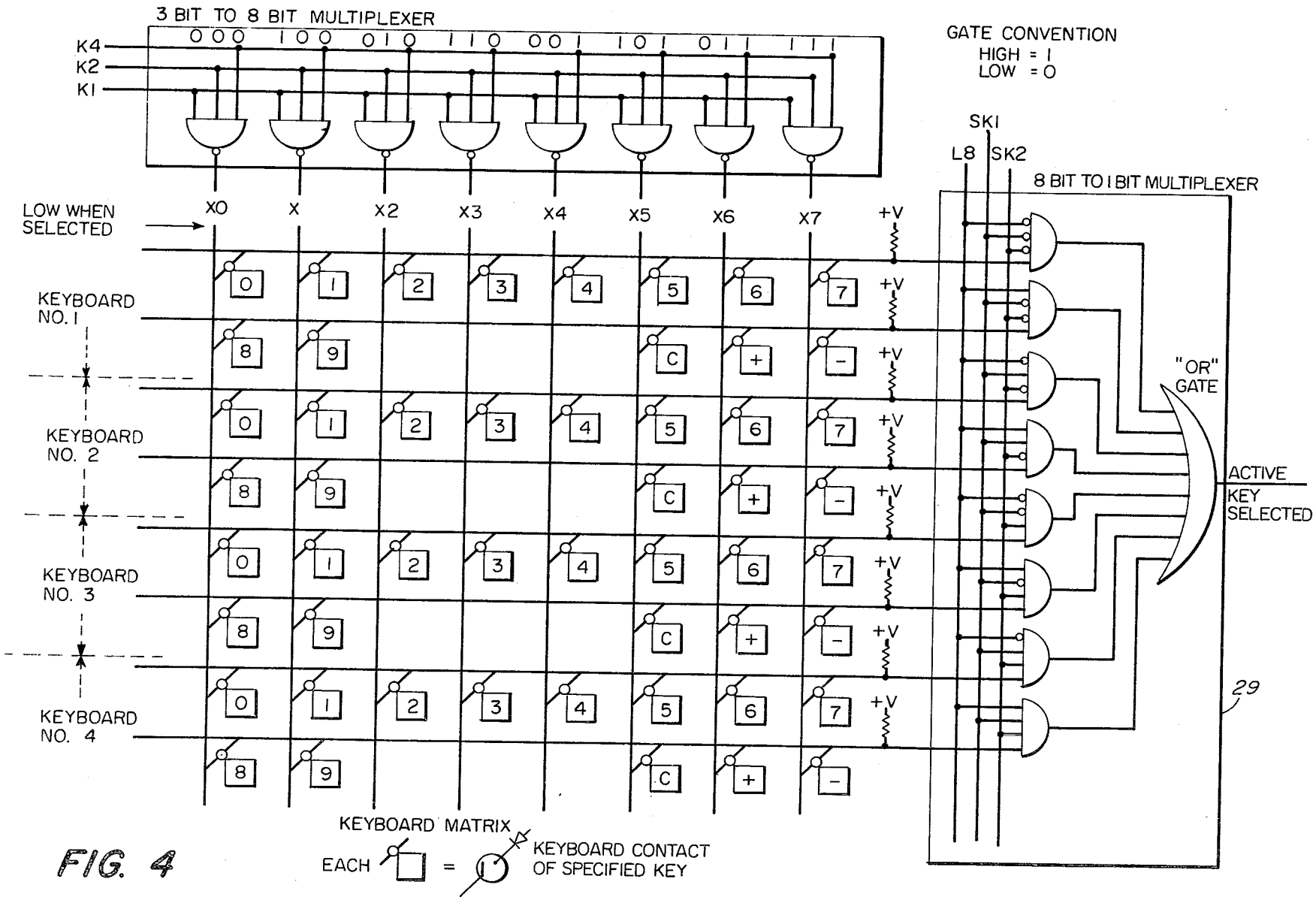
FIG. 4 is a schematic diagram of a keyboard matrix.

In FIG. 4, the keyboard matrix 28 is shown in greater detail. The matrix shown in FIG. 4 details keyboard Nos. 1, 2, 3 and 4, which represent the four player's keyboards included in a four player board. For each keyboard, keyboard contacts 0 to 9, C, + and − are shown, In series with each keyboard contact exists a diode, which represents a typical keyboard contact known to those skilled in the art. The three-bit to eight-bit demultiplexer is shown having gate output $x_0$ through $x_7$. The eight bit to one-bit multiplexer, having an active key-selected output, is shown as 29. As can be seen, lines $x_0$ through $x_7$ are low when selected by the depression of a keyboard contact within one of the keyboard numbers. Demultiplexer 30 has binary counter 31 inputs K1, K2 and K4, whereupon $x_0$ is brought low when specifically addressed by K1, K2 and K4. The specific binary address information necessary to bring outputs $x_2$ through $x_7$ low can be ascertained by those skilled in the art upon review of the gate diagrams. Counter 31 outputs K8, SK1 and SK2 are inputted into the eight-bit to one-bit multiplexer 29 to produce an active key selected output 35.

Figure 5:
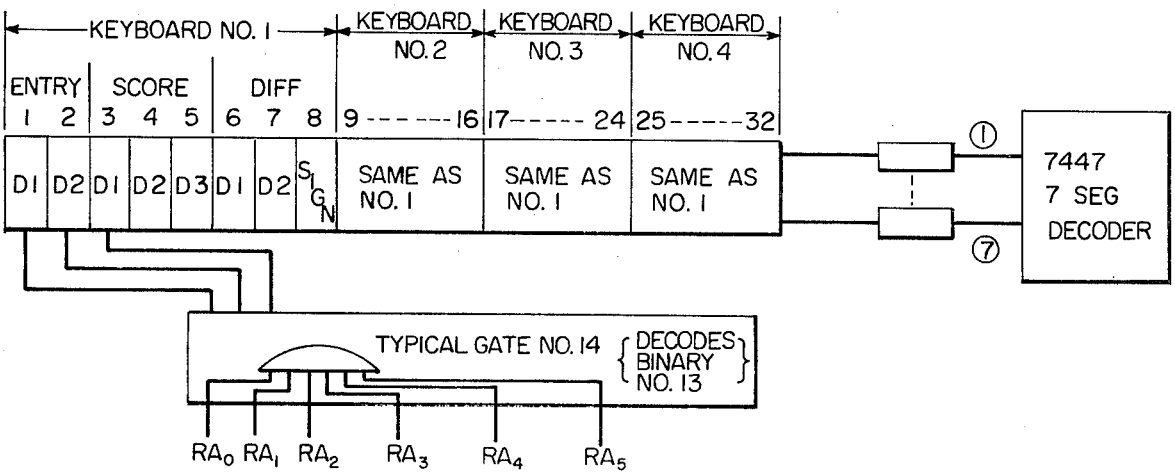
FIG. 5 is a schematic diagram of the display matrix.

In FIG. 5 is shown a detailed portion of the display subsystem 24, describing the 32-character display locations as well as their display purpose. At each display location there is a standard seven segment LED display device. As can be seen, the 32 display locations are divided into four segments, each segment being responsible for a keyboard. Display locations 1 through 8 are for keyboard No. 1, while display locations 9 through 16 are for keyboard no. 2, etc. The purpose of display locations 1 through 8 is identical to the purpose of display locations 9 through 16, 17 through 24, and 25 through 32. In order to address the thirty-two position display matrix, a seven segment decoder 57 is connected to the matrix, with a six-bit to forty-bit demultiplexer 56.

In FIG. 6 is shown a chart representing the format or organization of the random accessmemory 52. In the left hand column address information $A_0$ through $A_5$ is shown in the form of a six-bit binary number. The next column represents the address locations 0 through 39, while the right hand column represents the four-bit data input. Thus, a review of the chart reveals that the RAM 42 is organized so that Keyboard No. 1 utilizes address locations 0 through 7, Keyboard No. 2 utilizes addresses 9 through 15, Keyboard No. 3 utilizes addresses 16 through 23, and Keyboard No. 4 utilizes addresses 24 through 32. Addresses 32 through 39 are utilized by the "skunk" light, "skunk 1" and "skunk 2" in keyboards 1, 2, 3 and 4.

In FIG. 7 is shown a chart representing the keyboard encoding scheme. Shown for keys 0 through 9, "c", "+" and "−" are the four bits of data introduced into the RAM 42. For example, when key No. 2 is depressed for any of the keyboards 1 through 4 described above, the binary number 0010 is introduced into RAM 42 along lines 43. The exact binary configuration for each key depressed in each keyboard is thereby defined in FIG. 7.

Although, the device has been disclosed as one for use with four players a simpler version may have only two playing positions thus making the device smaller. The housing forms a common support for the input and display means, may be made of plastic, houses the electronics and preferably has the positions arranged in a similar array to the positions that the players assume at the table where the game is played.

What is claimed is:

1. A cribbage board scoring device defined by an electronic circuit means and comprising:

input means for each player including circuit means for registering numerical data, means responsive to said input means for providing a cumulative count for each player, means for displaying each cumulative count, and means for displaying a difference count corresponding to the difference between cumulative counts for two players, said electronic circuit means comprising:

a clock subsystem means connected to an instruction decode and sequence control subsystem to provide a synchronization time signal to the remaining portions of the circuit;

a keyboard subsystem means connected to a memory subsystem means to provide unprocessed data input to said circuit;

said memory subsystem means connected to a modification logic subsystem means and a display subsystem means to store said unprocessed data and processed data and communicate said processed data to a display subsystem;

said instruction decoding and sequence control subsystem means communicating command and sequence information to remaining portions of said circuit;

said modification logic subsystem means connected to said instruction decoding and sequence means to receive said unprocessed data from said memory subsystem and perform a function upon said unprocessed data to convert said unprocessed data to processed data, said processed data being transmitted to said memory subsystem;

a display subsystem means to receive said processed data from said memory subsystem and display said processed data on said display means.

2. A cribbage board scoring device in accordance with claim 1 wherein said clock subsystem means comprises an oscillator operating at a frequency of 640,000 Hz.

3. A cribbage board scoring device in accordance with claim 1 wherein said keyboard subsystem means comprises:

a keyboard matrix;

a multiplexer connected to said keyboard matrix;

a demultiplexer connected to said keyboard matrix;

a binary counter connected to said multiplexer and demultiplexer, said binary counter being free-running until said keyboard button is depressed, whereupon an output signal from said multiplexer stops said binary counter at a location representing a particular keyboard button depression;

a key operation device connected to said binary counter and said demultiplexer, said key operation decode being inputted with unprocessed data so as to provide keyboard status information to said instruction decode and sequence subsystem.

4. A cribbage board scoring device in accordance with claim 1 wherein said memory subsystem means comprises:

a random access memory;

a data selector connected to said random access memory and inputted by said unprocessed data from said keyboard subsystem means and by processed data from said modification logic subsystem means;

a random access memory address means connected to said random access memory; and a keyboard selection means connected to said random access memory means and inputted from said keyboard subsystem so that said random access memory is inputted with either said processed or said unprocessed data so as to provide an output to said display subsystem means or said modification logic means.

5. A cribbage board scoring device in accordance with claim 4 wherein said instruction decoding and sequence control subsystem means comprises:

a read only memory;

a binary counter connected to said read only memory;

a holdig register connected to said read only memory; and a demultiplexer connected to said holding register, the output being a plurality of command signals which are connected to all subsystems in the unit.

6. A cribbage board scoring device in accordance with claim 1 wherein said modification logic subsystem means comprises:

a plurality of storage and command gates connected to said random access memory output;

an adder-subtractor whose input lines are connected to said storage and command gates, and output lines connected to said data selector in said memory subsystem so that unprocessed data entering said storage and command gates is processed and returned to said memory subsystem.

7. A cribbage board scoring device in accordance with claim 1 wherein said display subsystem means comprises;

a plurality of display indicators;

a seven segment decoder; and a demultiplexer so that said decoder and demultiplexer are exercised to energize a particular display indicator.

8. A cribbage board scoring device comprising;

means defining a playing surface having at least first and second player stations, first and second keyboard input means associated, respectively, with the first and second stations, means responsive to said first and second input means for providing respective first and second cumulative counts, first and second means associated, respectively, with the first and second stations for displaying each cumulative count to provide cumulative scoring information for each player, means responsive to said first and second cumulative counts for providing a difference count and the polarity thereof respresentative of the difference between the scores between players continuously during the game, and first and second means associated respectively, with the first and second stations for displaying the difference count along with a polarity indication, a positive polarity of one station indicating a difference gain and a negative polarity at the other station indicating a difference loss.

9. A cribbage board scoring device in accordance with claim 8 wherein said input means comprises:

a plurality of keyboard buttons, each button being assigned a different numerical value or function so that a depression of a keyboard button inputs into said device a numerical value or function.

10. A cribbage board scoring device in accordance with claim 8 wherein said means for displaying each cumulative count comprises:

a plurality of seven segment with crystal display devices arranged to display a plurality of scoring information.

11. A cribbage board scoring device in accordance with claim 8 including means defining a surface for commonly supporting at least part of the input means and display means.

12. A cribbage board scoring device in accordance with claim 8 including means responsive to said cumulative counts for displaying a condition wherein one of said players has scored, at the end of a game, a predetermined number more than another player.

13. A cribbage board scoring device as set forth in claim 8 including first and second means associated, respectively, with the first and second stations and responsive to the first and second input means for displaying a last entry count at each station.

14. A cribbage board scoring device as set forth in claim 8 including means for displaying a skunk condition.

15. A cribbage board scoring device as set forth in claim 14 including means for also displaying a double skunk condition.

16. A cribbage board scoring device as set forth in claim 8 including a partner selection switch.

* * * * *